United States Patent [19]

Cardell

[11] 3,986,680

[45] Oct. 19, 1976

[54] BOBBIN TRANSFER TAIL RETAINER

[75] Inventor: Max Lee Cardell, Shelby, N.C.

[73] Assignee: Fiber Industries, Inc., Charlotte, N.C.

[22] Filed: May 13, 1974

[21] Appl. No.: 469,276

[52] U.S. Cl. ..... 242/125.1

[51] Int. Cl.[2] ..... B65H 75/28

[58] Field of Search ..... 242/125.1, 18 PW; 24/DIG. 18

[56] References Cited

UNITED STATES PATENTS

| | | | |
|---|---|---|---|
| 3,284,023 | 11/1966 | Sowell | 242/125.1 |
| 3,625,451 | 12/1971 | Anderson | 242/125.1 |

FOREIGN PATENTS OR APPLICATIONS

| | | | |
|---|---|---|---|
| 1,557,744 | 1/1969 | France | 242/125.1 |
| 450,855 | 4/1968 | Switzerland | 242/125.1 |
| 253,745 | 6/1926 | United Kingdom | 242/125.1 |

*Primary Examiner*—Leonard D. Christian
*Attorney, Agent, or Firm*—H. M. Adrian, Jr.

[57] ABSTRACT

A novel bobbin is described for the winding of synthetic yarn in which the bobbin has means for temporarily securing the yarn end which is used as a bobbin to bobbin transfer tail. The yarn end is held on the winding surface of the bobbin by retainer means in a position whereby the yarn end can be easily picked up and unwound a few turns for the making of a yarn transfer tail. The yarn retainer comprises a strip of hook and loop fastener to which the yarn end readily adheres.

4 Claims, 2 Drawing Figures

BOBBIN TRANSFER TAIL RETAINER

This invention relates to a bobbin for the winding of yarn and more particularly to a bobbin which has means thereon to retain the yarn end in a manner wherein the beginning end at the core of the yarn package on a fully wound bobbin can be unwound one or more turns to provide sufficient length of yarn to tie the yarn end to another end on another yarn package thereby forming a transfer tail.

BACKGROUND OF THE INVENTION

In the winding of yarns onto bobbins, difficulties are often encountered in maintaining an available length of yarn at the core of the winding for use in connecting or tying a plurality of yarn packages together as is often needed in continuous fiber processing operations. The yarn end is referred to as a transfer tail. The available end of yarn cannot be loose in a sense that it dangles from the bobbin but rather in the sense that it can be made available when needed by unwinding a few turns of yarn next to the package core. This available end cannot be overlaid with yarn windings forming the yarn package.

If the yarn transfer tail is wound onto the bobbin along with the rest of the yarn, the transfer tail is only available after all the yarn on the bobbin is used. This would require the stopping of the process and an accompanying delay in production of finished product to find the yarn end and tie the end to the yarn of the next package to be used. If the yarn end merely hangs loose, it becomes a nuisance in packaging, can become entangled with other loose yarn ends or be broken off from the bobbin.

THE INVENTION

In accordance with the present invention, a yarn bobbin is described having a transfer tail retainer thereon said bobbin comprising a cylindrical tube for the winding of yarn thereon, said tube having located in the proximity of one end of said tube on the peripheral thereof at least one elongated strip of hook and loop fasteners.

The present invention provides for easier startup of a winding operation while ensuring the retention of the yarn end in a convenient and available location for subsequent use in forming a transfer tail with another yarn package.

DETAILS OF THE INVENTION

In a most preferred embodiment, the hook and loop fasteners are positioned in a ringed groove position outside of the normal traverse range of the yarn winding package build. In the commencing of a package winding operation, an unfilled bobbin is rotated at a winding speed with the initial winding of the yarn commencing at the end of the bobbin wherein the elongated strip of hook and loop fastener is located. The fasteners grasp the yarn and commence the winding of the yarn onto the bobbin to form the package. At about the same time the running length of yarn is picked up on a traverse guide which commences the yarn package build on that remaining portion of the bobbin which is not covered by the strip of hook and loop fastener.

Figure 1:
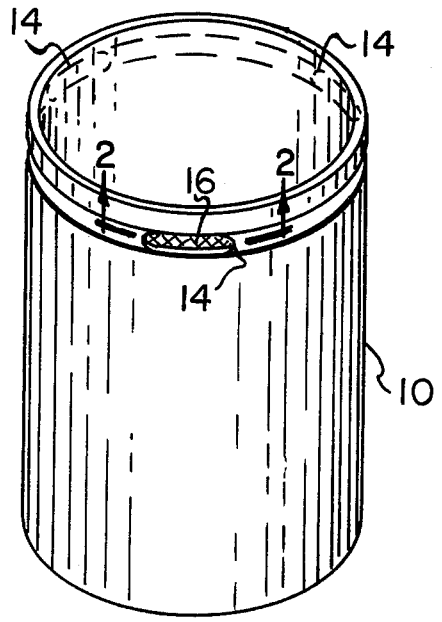
Figure 2:
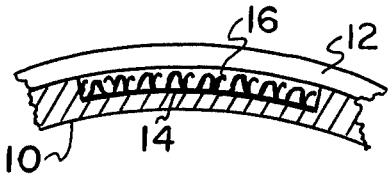

The invention will be more fully described by reference to the drawings in which;

FIG. 1 is a perspective view of a preferred bobbin in accordance with the present invention; and FIG. 2 is a partial sectional view along line 2—2 showing the detail of the hook and loop fastener.

The bobbin is basically a uniform cylinder of size adopted for placement on known yarn winding apparatuses. The cylinder 10 can be made out of plastic material such as polyacetyl, nylon, polypropylene, polyester, reinforced plastic, metal, cardboard, or other suitable rigid materials.

Located on one end of cylinder 10 is preferably a grooved ring 12 encircling the peripheral of cylinder 10. Within groove 12 is recess 14 wherein hook and loop fastener 16 is positioned. Such fasteners need not exceed approximately one to two inches in length and one such fastener is sufficient. It is desirable to have the fastener length long enough to take advantage of the cylindrical curvature such that when a yarn is wrapped tightly around the bobbin surface, it will penetrate into the hook and loop fastener thereby ensuring adhesion. However, to ensure faster yarn pickup in initiating the winding step, two or more such fasteners are preferably used equally spaced around the peripheral in ring 12. A continuous length of fastener can be used but experience has indicated that such extended lengths result in difficulty in extracting the yarn end quickly from the fastener when forming a transfer tail.

Groove 12 can be omitted but is preferred to thereby provide greater recessing of the fastener from the face of the cylinder and to more quickly engage the yarn end in fastener 12 on stringup. The positioning of hook and loop fastener is outside the normal traverse range of the yarn package building guide. The yarn package is thus built toward the interior portion of the bobbin away from the immediate location of the hook and loop fastener. In this manner, a number of yarn wrappings can be picked up by the fastener which are not overlaid with the yarn package build.

The hook and loop fasteners are of the type described in U.S. Pat. No. 2,717,437 and 3,009,235. Such fasteners comprise synthetic loops projecting from a fiber base which loops are fractured to form rigid but flexible hooks which readily grasp fibrous articles. Such loops are conventionally made of polyester or nylon monofilament material of a heavy denier such as to form relatively rigid looped structures the projecting loops being cut or severed to form hooks.

In the preferred embodiments of the present invention, the fasteners are recessed below the bobbin winding surface. While such fasteners can project above the surface, such recessed fasteners reduce or eliminate the adhering of other yarn ends which are not desirably adhered to the bobbin. Additionally the recessing protects the fastener from being abraded or damaged. Thus recessed fasteners perform their intended function only in winding operations wherein the yarn is specifically passed in a tension manner across the surface of the fastener.

While the invention has been described more specifically with the preferred embodiments it is recognized that variations from such preferred embodiments will be readily recognized by those skilled in the art. Consequently, it is intended that the invention be limited only by the appended claims.

What is claimed is:

1. A yarn bobbin having a transfer tail retainer comprising a cylindrical tube for the winding of yarn thereon, said tube having located on the exterior surface of said tube in the proximity of one end of said tube a circumscribed groove positioned around the peripheral thereof, at least one group of a plurality of individual hooks and loops forming fastener means being positioned in said groove below the peripheral surface of said groove.

2. The bobbin of claim 1 wherein the fastener means is recessed below the groove depth with the upper surface of said fastener means being at a level with the bottom of said groove to just below the top of said groove.

3. The bobbin of claim 1 wherein at least two groups of fastener means are positioned in a spaced apart relationship on said tube.

4. The bobbin of claim 1 wherein the fastener means is about one to two inches in length.

* * * * *